US006824417B1

(12) United States Patent
Nimura

(10) Patent No.: US 6,824,417 B1
(45) Date of Patent: Nov. 30, 2004

(54) CONNECTION DETECTING CONNECTOR AND A CONNECTION DETECTING CONNECTOR ASSEMBLY

(75) Inventor: Kazuhiko Nimura, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/625,143

(22) Filed: Jul. 23, 2003

(30) Foreign Application Priority Data

Jul. 24, 2002 (JP) ..... 2002-215605

(51) Int. Cl.[7] ..... H01R 13/627
(52) U.S. Cl. ..... 439/352; 439/489; 439/752
(58) Field of Search ..... 439/489, 352, 439/488, 357, 358, 752

(56) References Cited

U.S. PATENT DOCUMENTS 5,120,255 A 6/1992 Kouda et al.
5,643,003 A * 7/1997 Myer et al. ..... 439/352
5,803,651 A * 9/1998 Saito ..... 403/329
5,879,180 A * 3/1999 Iwahori et al. ..... 439/352
6,126,480 A * 10/2000 Kawase et al. ..... 439/489
6,461,186 B1 * 10/2002 Endo ..... 439/352
6,468,105 B2 * 10/2002 Noguchi et al. ..... 439/489
6,514,099 B2 * 2/2003 Endo ..... 439/489
6,712,635 B1 * 3/2004 Nimura ..... 439/352

* cited by examiner

*Primary Examiner*—P. Austin Bradley
*Assistant Examiner*—X. Chung-Trans
(74) *Attorney, Agent, or Firm*—Gerald E. Hespos; Anthony J. Casella

(57) ABSTRACT

A lock projection (17) is formed on an outer surface of a lock arm (16) as a locking means for locking a first and a second connectors (10, 40) in their connected state and locking projections (19F, 19R) are formed on an inner surface of the lock arm (16) for holding a detector (30) at a standby position. Thus, the lock arm (16) has a higher strength as compared to the one formed with an opening penetrating the lock arm from the outer surface to the inner surface.

11 Claims, 14 Drawing Sheets

CONNECTION DETECTING CONNECTOR AND A CONNECTION DETECTING CONNECTOR ASSEMBLY

BACKGROUND OF THE INVENTION

1. Field of the Invention

The invention relates to a connector and a connector assembly provided with a connection detecting function.

2. Description of the Related Art

A connection detecting connector assembly is known from U.S. Pat. No. 5,120,255. This connector assembly is constructed such that a first connector having a lock arm extending along an outer surface of a housing is connectable with a second connector. The lock arm locks the two connectors into each other, and a detector is movably provided between the housing and the lock arm.

The detector is held at a standby position in the process of connecting the connectors, but can move to a detection position when the connectors reach a properly connected state. In this way, whether the connectors are properly connected can be detected based on whether the detector can be moved from the standby position to the detection position.

In the above prior art connector assembly, the two connectors are locked into each other by engaging the outer surface of the lock arm with the second connector, and the detector is held at the standby position by being engaged with the lock arm from the inner side. The lock arm is formed with an opening that penetrates the lock arm from its outer surface to its inner surface. An outer opening edge of the opening functions as a locking means for locking the second connector and an inner opening edge thereof functions as a locking means for locking the detector. However, the through hole in the lock arm reduces the strength of the lock arm on the prior art connector.

In view of the above problem, an object of the present invention is to ensure a sufficiently strong lock arm.

SUMMARY OF THE INVENTION

The invention relates to a connection detecting connector connectable with a mating connector. The connector comprises a lock arm extending substantially along an outer surface of a housing, and a detector between the housing and the lock arm. The detector is movable between a standby position and a detection position. The detector is held at the standby position by the engagement with the lock arm from inner side in the process of connecting the two connectors, but can move to the detection position when the two connectors are connected properly. A lock projection is formed on an outer surface of the lock arm for locking the two connectors in their connected state by engaging a receiving portion of the mating connector. At least one locking projection is formed on the inner surface of the lock arm for engaging the detector and holding the detector at the standby position.

The lock projection is formed on the outer surface of the lock arm as a locking means for locking the two connectors in their connected states, and the locking projection is formed on the inner surface of the lock arm as a locking means for holding the detector at the standby position. Thus, the projections are formed as the locking means instead of a recess and, accordingly, an opening in the form of a through hole need not be formed in the lock arm. Thus, the lock arm is stronger than one formed with an opening penetrating the lock arm from the outer surface to the inner surface as a locking means.

The detector that has moved to the detection position preferably is prevented from returning to the standby position by the engagement of a resilient locking piece in the detector with the inner surface of the lock arm.

Preferably, a part of the resilient locking piece is exposed to outside at the side of the lock arm and the resilient locking piece can be displaced in a direction to be disengaged from the lock arm by bringing a jig into contact with an exposed surface of the resilient locking piece.

The jig may be brought into contact with the exposed surface of the resilient locking piece to resiliently deform the resilient locking piece for disengaging the resilient locking piece from the lock arm. Part of the resilient locking piece preferably is exposed to outside at the side of the lock arm. Thus, the lock arm need not be formed with a window hole to insert the jig, thereby ensuring a sufficient strength of the lock arm.

The detector may comprise a displacement restricting portion that can be located between the housing and the lock arm with the detector at or near the detection position for restricting displacement of the lock arm in unlocking direction. Thus, the connectors can be locked securely together.

The connection detecting connector may further comprise at least one guiding portion for hindering loose movements of the detector along a direction intersecting with moving directions of the detector while the detector is moved between the standby position and the detection position.

The detector preferably has at least one guidable portion to be guided by the guiding portion at a side of the resilient locking piece substantially opposite from the lock arm. Thus, the detector can move smoothly and securely along a specified path between the detection position and the standby position.

The guidable portion preferably is formed with a deformation space for avoiding interference with the resilient locking piece when the resilient locking piece is deformed in a direction to be disengaged from the lock arm.

The deformation space for the resilient locking piece takes advantage of the thickness of the guidable portion. Thus, the first connector can have a shorter height with respect to the resiliently deforming direction of the resilient locking piece as compared to a structure in which a space defined between a guidable portion and a resilient locking piece serves as a deformation space.

At least one locking surface engageable with the resilient locking piece is formed on the inner surface of the lock arm. Additionally, the housing is formed with a retainer-accommodating hole for at least partly accommodating a retainer for locking at least one terminal fitting at least partly inserted into the housing. The locking surface is substantially parallel with a mounting direction of the retainer into the retainer-accommodating hole. Thus, a mold for forming the locking surface and the one for forming the retainer accommodating hole can be removed in the substantially same direction. This enables the locking surface and the retainer-accommodating hole to be formed by one mold.

The invention also relates to a connection detecting connector assembly. The assembly preferably comprises a connection detecting connector as described above as a first connector. The assembly also comprises a second connector connectable with the first connector. The first and second connectors are locked in their connected state by engaging an outer side of the lock arm with the second connector with the first and second connectors connected with each other.

The second connector may comprise an auxiliary guiding portion for hindering loose movements of the detector along a direction intersecting with the moving directions of the detector while the detector is moved between the standby position and the detection position with the second connector connected with the first connector.

The detecting member preferably comprises a guidable portion to be guided by the guiding portion or the auxiliary guiding portion at a side of the resilient locking piece opposite from the lock arm, and the guidable portion is formed with a deformation space for avoiding an interference with the resilient locking piece when the resilient locking piece is resiliently deformed in such a direction as to be disengaged from the lock arm.

These and other features and advantages of the invention will become more apparent upon reading the following detailed description and accompanying drawings. Even though embodiments are described separately, single features thereof may be combined to additional embodiments.

DETAILED DESCRIPTION OF THE PREFERRED EMBODIMENTS

Figure 1:
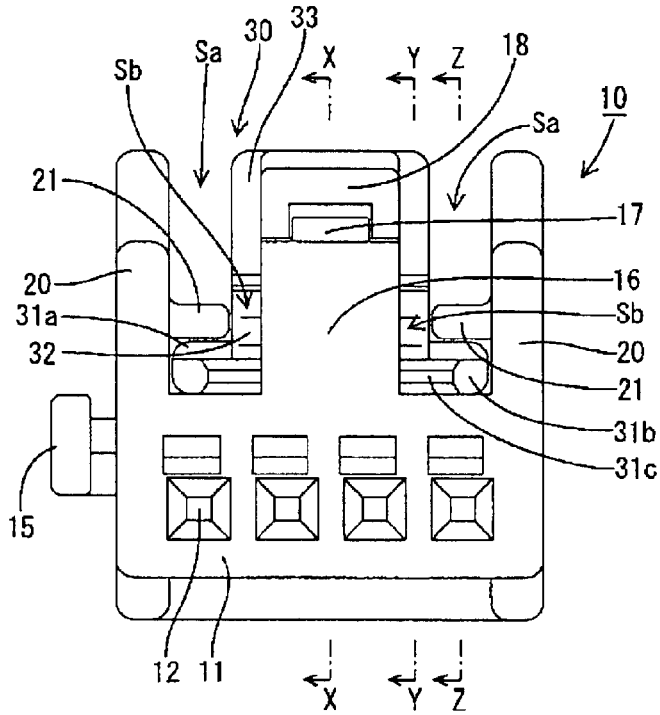
FIG. 1 is a front view of a first connector assembled with a detecting member in one preferred embodiment of the invention.
Figure 2:
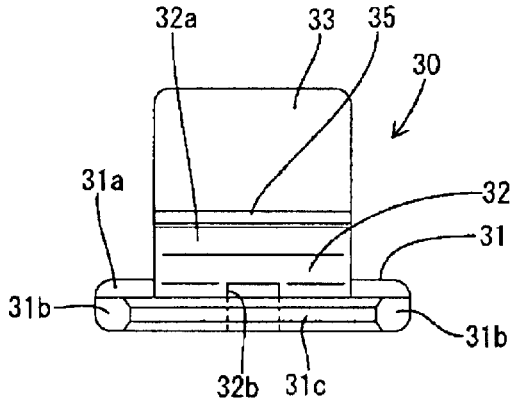
FIG. 2 is a front view of the detecting member.
Figure 3:
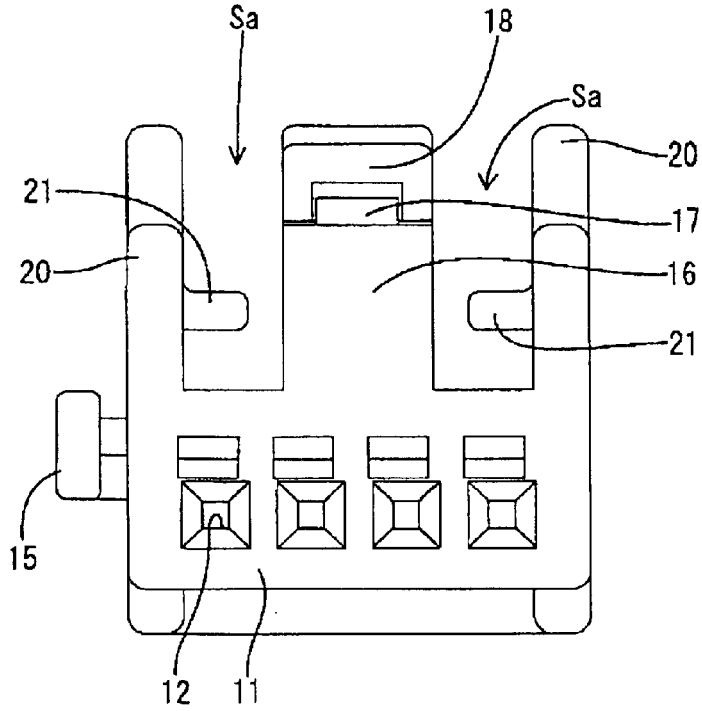
FIG. 3 is a front view of a housing of the first connector.

Hereinafter, one preferred embodiment of the present invention is described with reference to FIGS. 1 to 15.

A connector detecting connector assembly of this embodiment is comprised of a first connector 10 including a detector 30 and a retainer 15, and a second connector 40 connectable with the first connector 10. In the following, a mating side of the first connector 10 with the second connector 40 is referred to as front or front side.

The first connector 10 is such that one or more, preferably a plurality of cavities 12 are transversely arranged substantially side by side (in one or more stages) in a housing 11 made e.g. of a synthetic resin, and one or more female terminal fittings 13 are at least partly insertable into the respective cavities 12 from an insertion direction ID, preferably from behind. The housing 11 is formed with a retainer accommodating hole 14 which is open preferably in the lateral (right) side surface of the housing 11 and substantially communicates with all the cavities 12, and the retainer 15 which is a part separate from the housing 11 is or can be at least partly accommodated in the retainer accommodating hole 14. The retainer accommodating hole 14 extends in transverse direction (substantially normal to an inserting direction ID of the female terminal fittings 13 into the cavities 12), and a mold (not shown) for forming this retainer accommodating hole 14 is removed to a lateral direction e.g. to the right with respect to the housing 11 (to up in FIGS. 4 and 5 and to left in FIG. 10). The retainer 15 to be at least partly mounted into the retainer accommodating hole 14 prevents all the female terminal fittings 13 from being withdrawn backward (or in a direction substantially opposite to the inserting direction ID) by being engaged with the female terminal fittings 13 at least partly inserted into the respective cavities 12.

The housing 11 is formed unitarily with a lock arm 16 extending substantially along the upper surface 11O. The upper surface 11O of the housing 11 is substantially flat and substantially parallel with a connecting direction CD of the two connectors 10, 40. The lock arm 16 stands up or projects from the front end or front end portion of the upper surface 11O of the housing 11, extends backward substantially horizontally (substantially parallel with the upper or outer surface 11O of the housing 11) while being spaced apart from the upper surface 11O of the housing 11, and preferably is supported only at one end. Thus, the lock arm 16 is deformable along a deformation direction DD preferably being substantially vertically resiliently deformable or substantially along a direction toward and away from the housing 11. A lock projection 17 is formed at a substantially middle position of the upper surface of the lock arm 16 with respect to forward and backward or longitudinal directions, and an operable or unlocking portion 18 projects upward or outward from the rear end (free or distal end) of the upper or outer surface of the lock arm 16.

On the other hand, front and rear locking projections 19F, 19R engageable with a resilient locking piece 32 of the detector 30 to be described later are formed on the lower surface (inner surface facing the upper or outer surface 11O of the housing 11) of the lock arm 16. A front surface 19Fa of the front locking projection 19F and a rear surface 19Rb of the rear locking projection 19R are flat surfaces substantially oblique to the connecting direction CD of the two connectors 10, 40 (or a relative moving direction of the detector 30 with respect to the first connector 10), and a rear surface 19Fb (as a preferred locking surface) of the front locking projection 19F and a front surface 19Ra of the rear locking projection 19R are substantially flat surfaces substantially normal to the connecting direction CD of the two connectors 10, 40. The front and rear surfaces 19Fa, 19Fb, 19Ra, 19Rb of these two locking projections 19F, 19R extend substantially in transverse direction, and a mold (not shown) for forming these surfaces is removed to a lateral side, e.g. to right, i.e. in the substantially same direction as the mold for the retainer accommodating hole 14 is removed. Thus, both molds can be made integral or unitary to each other and/or can be moved together.

The lock arm 16 is located in the widthwise (transverse) center of the housing 11, and the width thereof is, for example, about ⅓ to ¼ of that of the housing 11. Further, a pair of protection walls 20 stand up from the lateral (left and right) edges or edge portions of the upper surface 11O of the housing 11 to prevent the interference of external matters with the lock arm 16. An insertion space Sa into which a jig J is at least partly insertable is defined between each of the lateral (left and right) surfaces of the lock arm 16 and the inner surface of the corresponding protection wall 20. The insertion spaces Sa are open upward, forward and backward.

Left and right guiding portions extending substantially straight in forward and backward directions (directions substantially parallel with moving directions MD of the detecting member 30 with respect to the housing 11) and preferably being in the form of ribs projecting inward are formed at rear end portions of the inner surfaces of the left and right protection walls 20. These guiding portions 21 are spaced apart from the upper surface 11O of the housing 11 by a specified distance (preferably a spacing corresponding to the thickness of a rear end portion of a guidable portion 31 of the detecting member 30). A cut-away portion 22 substantially communicating with the entrance of the retainer accommodating hole 14 is formed in areas of the lateral (right) protection wall 20 and the lateral (right) end of the upper surface 11O of the housing 11 corresponding to the retainer accommodating hole 14.

The detector 30 is made e.g. of a synthetic resin and is comprised of the guidable portion 31 preferably having a substantially rectangular plan view, a resilient locking piece 32 extending from the guidable portion 31 and a grip portion 33 standing up or projecting from or at the rear end of the guidable portion 31. The detector 30 is movable along forward and backward or longitudinal directions or along a moving direction MD between a standby position (see FIGS. 4, 9, 10, 11) where the lower or inner surface of the guidable portion 31 is held substantially in surface contact with the upper surface 11O of the housing 11 and at least a front end portion thereof is accommodated between the housing 11 and the lock arm 16 and a detection position (see FIGS. 12 to 15) located before the standby position.

The guidable portion 31 includes a flat portion 31*a* having a specified thickness and a substantially rectangular plan view, left and right frame portions 31*b* extending substantially straight forward (direction substantially parallel with the moving directions MD of the detecting member 30) from the flat portion 31*a*, and a front frame portion 31*c* coupling (the front ends of) the left and right frame portion 31*b*. The lower surface of the guidable portion 31 preferably is entirely substantially flat, but the upper surfaces of the left, right and front frame portions 31*b*, 31*c* are located lower or more projecting than that of the flat portion 31*a*. The upper surface of the flat portion 31*a* is located slightly lower than the lower surfaces of the guiding portions 21. The guidable portion 31 is also formed with a deformation space 34 substantially enclosed by the flat portion 31*a*, the lateral (left and right) frame portions 31*b* and the front frame portion 31*c*. This deformation space 34 is open in the upper and lower surfaces of the guidable portion 31.

The resilient locking piece 32 extends obliquely upward or outward to the front or toward the second connector 40 from the front edge or edge portion of the flat portion 31*a* while preferably being supported only at one end and is in the form of a plate as a whole. The resilient locking piece 32 is formed within the deformation space 34 in a plane spreading in forward, backward and transverse directions (when viewed from above or from the side where the lock arm 16 is provided on the housing 11). Although the rear end of the resilient locking piece 32 is located in the deformation space 34, a most part of the resilient locking piece 32 extending from its front end (free end) to the rear end projects more upward or outward than the deformation space 34 (left and right frame portions 31*b* and front frame portion 31*c*). A locking portion 32*a* in the form of a projection is formed on the upper or outer surface of the front end of the resilient locking piece 32. An area of the resilient locking piece 32 behind the locking portion 32*a* is cut along forward and backward or longitudinal directions preferably substantially in the widthwise center, thereby forming a cut-out portion 32*b*.

The width of the resilient locking piece 32 is set larger than that of the lock arm 16 and slightly smaller than the spacing between the two guiding portions 21. With the detecting member 30 mounted in the housing 11, the left and right sides of the resilient locking piece 32 constantly bulge out at the left and right sides of the lock arm 16 (i.e. clearances between the lateral or left and right surfaces of the lock arm 16 and the guiding portions 21), and these bulging portions 32*s* of the resilient locking piece 32 can be seen from above or obliquely from upper-back side. In other words, the jig J can be brought substantially into contact with the left and right sides of the resilient locking piece 32 from above or obliquely from upper-back side.

The grip portion 33 is located preferably substantially in the widthwise center of the upper surface of the flat portion 31*a* and is in the form of a wall standing up or projecting from or at the rear end of the flat portion 31*a*. The width of the grip portion 33 is set slightly smaller than the spacing between the left and right guiding portions 21, i.e. preferably substantially equal to the resilient locking piece 32. A displacement restricting portion 35 having the same width as the grip portion 33 and a substantially rectangular side view projects from the front surface of the grip portion 33. The upper surface of this displacement restricting portion 35 is located slightly lower than the lower surface of the rear end (unlocking portion 18) of the lock arm 16 in its free state (state where the lock arm 16 is engaged with the second connector 40).

With the detector 30 located at the standby position, the grip portion 33 and the displacement restricting portion 35 project back from the rear end of the lock arm 16 and the resilient locking piece 32 at least partly slips under the lock arm 16 to at least partly fit the locking portion 32*a* thereof into a clearance between the locking projections 19F, 19R. The detector 30 is held at the standby position by the engagement of the locking portion 32*a* and the locking projections 19F, 19R while being prevented from making loose movements in forward and backward directions. Further, the front end portion of the flat portion 31*a* of the guidable portion 31 is tightly held between the upper surface 11O of the housing 11 and the guiding portions 21, whereby the detecting member 30 is held in such a posture where the bottom surface thereof is substantially in contact with the upper surface 11O of the housing 11.

With the detector 30 located at the detection position, the locking portion 32*a* of the resilient locking piece 32 is substantially engaged with the front locking projection 19F from front, thereby preventing the detector 30 from making loose backward movements, and the grip portion 33 is substantially in contact with the unlocking portion 18 from behind, thereby preventing the detecting member 30 from making loose forward movements. As a result, the detector 30 is held at the detecting portion without making loose movements. Since the displacement restricting portion 35 slips under the rear end of the lock arm 16, downward resilient deformations of the lock arm 16 are restricted.

Further, since the grip portion 33 is closely held in surface contact with the rear surface of the unlocking portion 18, it is difficult to place fingers before the grip portion 33.

The second connector 40 includes a substantially rectangular receptacle 41 which is open forward, and one or more tabs 42 at the leading ends of male terminal fittings at least partly project into the receptacle 41. When the first connector 10 is at least partly fitted into the receptacle 41, the tabs 42 are connected with the female terminal fittings 13.

A receiving portion 43 projecting downward or inwardly is formed at the front edge or edge portion (opening edge) of the upper or outer plate of the receptacle 41. This receiving portion 43 is located preferably substantially in the widthwise center so as to substantially conform to the lock projection 17 on the outer surface of the lock arm 16. In the process of connecting the two connectors 10, 40, the lock arm 16 is resiliently deformed in the deforming direction DD, preferably downward or inwardly, by the interference of the lock projection 17 with the receiving portion 43, and at least partly resiliently returns to engage the lock projection 17 with the receiving portion 43 when the lock projection 17 passes the receiving portion 43. As a result, the two connectors 10, 40 are locked in their properly connected state. If the two connectors 10, 40 are left partly connected without the lock projection 17 passing the receiving portion 43, the lock arm 16 remains resiliently deformed and the rear end thereof is located lower or more inward than the upper surface of the displacement restricting portion 35, i.e. the rear end of the lock arm 16 is located at such a position as to at least partly face the front surface of the displacement restricting portion 35 substantially at the same height.

Left and right auxiliary guiding portions 44 in the form of walls project down from the upper plate of the receptacle 41 and preferably substantially continuously extend from the front end of the receptacle 41 to the back end surface thereof. The auxiliary guiding portions 44 are so located as to substantially transversely conform to the lateral (left and right) sides of the guidable portion 31 of the detector 30, and the lower surfaces thereof are located slightly higher more outward than the upper surfaces of the left and right frame portions 31*b*. In the process of connecting the two connectors 10, 40, front end portions of the left and right frame portions 31*b* of the detector 30 located at the standby position slip under the auxiliary guiding portions 44 preferably immediately after the tabs 42 start entering the first connector 10 and the left and right frame portions 31*b* are kept substantially in sliding contact with the lower surfaces of the auxiliary guiding portions 44 from this stage on until the two connectors 10, 40 are properly connected. Even if the two connectors 10, 40 are properly connected, the guiding portions 21 and the auxiliary guiding portions 44 do not interfere with each other since the guiding portions 21 of the first connector 10 are located outside the receptacle 41.

The upper plate of the receptacle 41 is also formed with a pair of left and right leading portions 45 projecting inward from the inner surfaces of the auxiliary guiding portions 44 and projecting down or inwardly from this upper or outer plate. The leading portions 45 are so located as to substantially transversely conform to the left and right sides of the resilient locking piece 32, and the lower surfaces thereof preferably are located substantially at the same height as the lower surface of the front locking projection 19F with the lock projection 17 of the lock arm 16 engaged with the receiving portion 43 (with the two connectors 10, 40 properly connected). With the two connectors 10, 40 properly connected with each other, the front locking projection 19F is located right before the leading portions 45 with respect to the moving direction MD of the detector 30 from the standby position to the detection position. The receiving portion 43 is located between the two leading portions 45.

Figure 10:
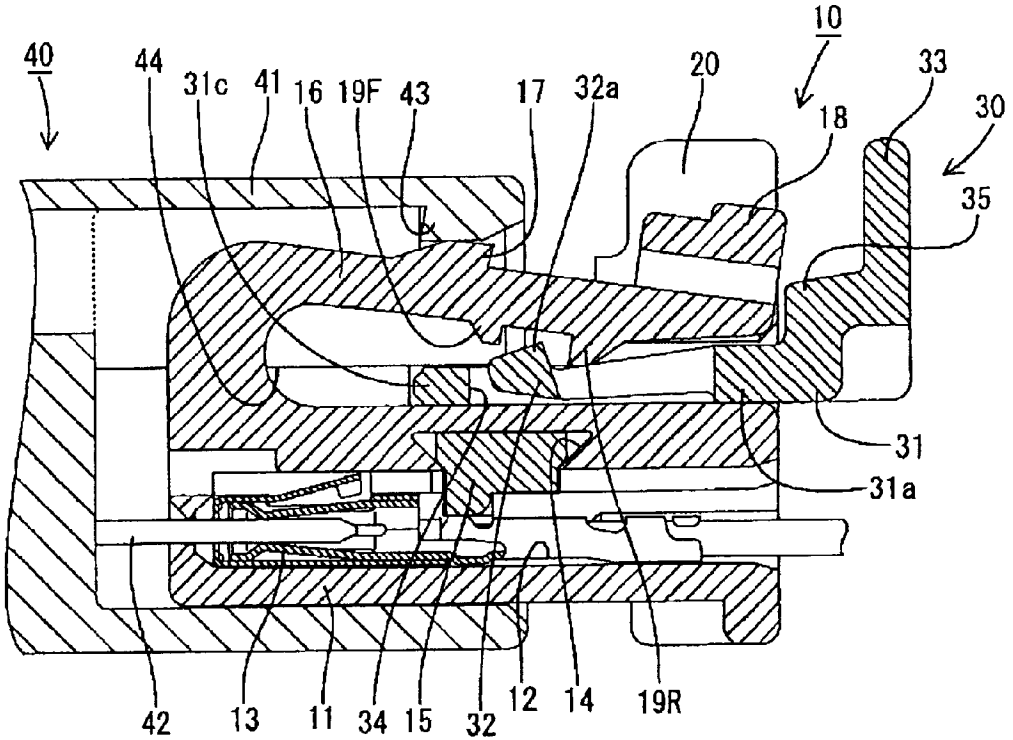
FIG. 10 is a section similar to FIG. 9, but showing an intermediate stage of connection of the two connectors.

Upon connecting the two connectors 10, 40 along the connecting direction CD, the detector 30 is first held at the standby position. When the first connector 10 is at least partly fitted into the receptacle 41 in this state, the lock projection 17 comes substantially into contact with the receiving portion 43 and, thereafter, the lock arm 16 is resiliently deformed in the deforming direction, preferably downward or inwardly, whereby the resilient locking piece 32 is resiliently pressed (down) by the rear locking projection 19R as shown in FIG. 10. At this time, the resilient deformation of the resilient locking piece 32 is possible or not hindered, since the deformation space 34 is defined below the resilient locking piece 32. At this time, the two connectors 10, 40 are left partly connected, and the movement of the detector 30 to the detection position in the moving direction MD is hindered due to the contact of the displacement restricting portion 35 with the rear end of the lock arm 16 even if an attempt is made to push the detector 30 in the moving direction MD, preferably forward, in this state.

Figure 11:
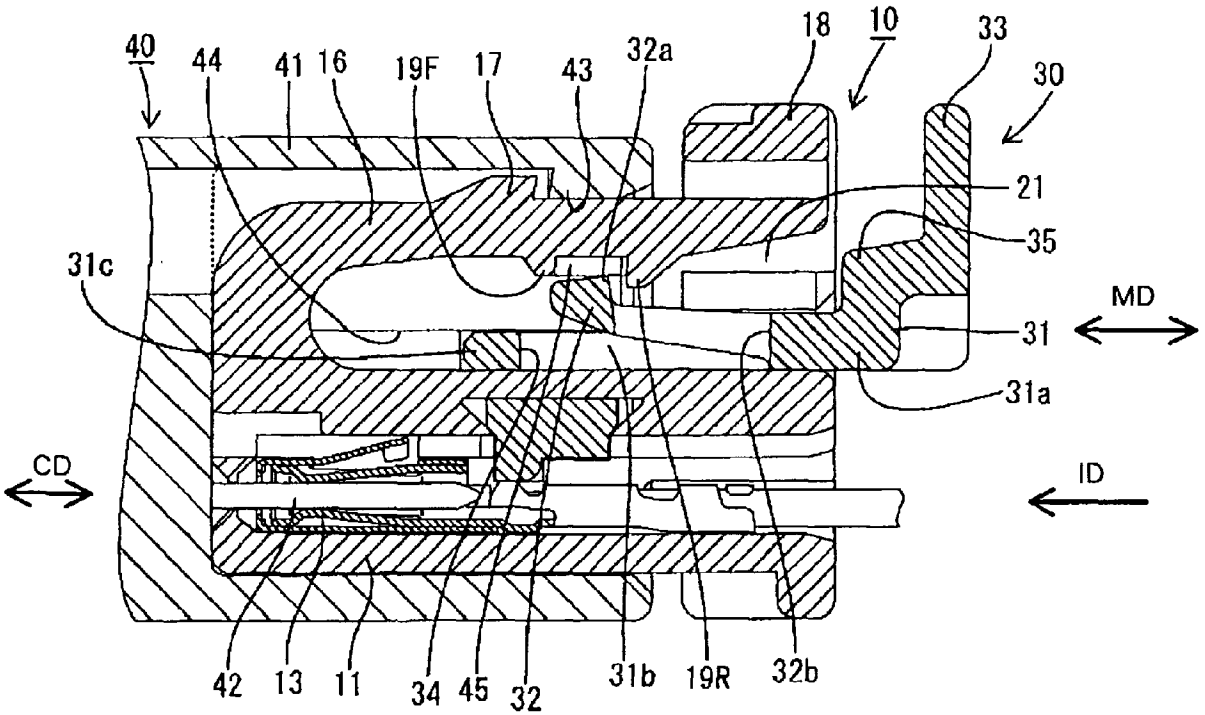
FIG. 11 is a section similar to FIG. 9, but showing a state where the two connectors are properly connected.

When the two connectors 10, 40 reach their properly connected state, the lock arm 16 resiliently returns and the two connectors 10, 40 are locked in their properly connected state by the engagement of the lock projection 17 and the receiving portion 43 as shown in FIG. 11. As the lock arm 16 at least partly resiliently returns, the resilient locking piece 32 having been pushed, preferably down or inwardly, tries to resiliently return in an opposite direction, preferably upward. However, as shown in FIG. 11, the resilient locking piece 32 cannot return to such a height as to be engaged with the locking projections 19F, 19R since the locking portion 32*a* of the resilient locking piece 32 is substantially in contact with the lower surfaces of the leading portions 45 of the receptacle 41 with the connectors 10, 40 properly connected with each other. Here, the lower surfaces of the leading portions 45 are located right before the lower surface of the front locking projection 19F substantially at the same height. Thus, the movement in the moving direction MD (forward movement) of the detector 30 having been prevented by the engagement of the locking portion 32*a* and the locking projections 19*f*, 19R is permitted.

Figure 12:
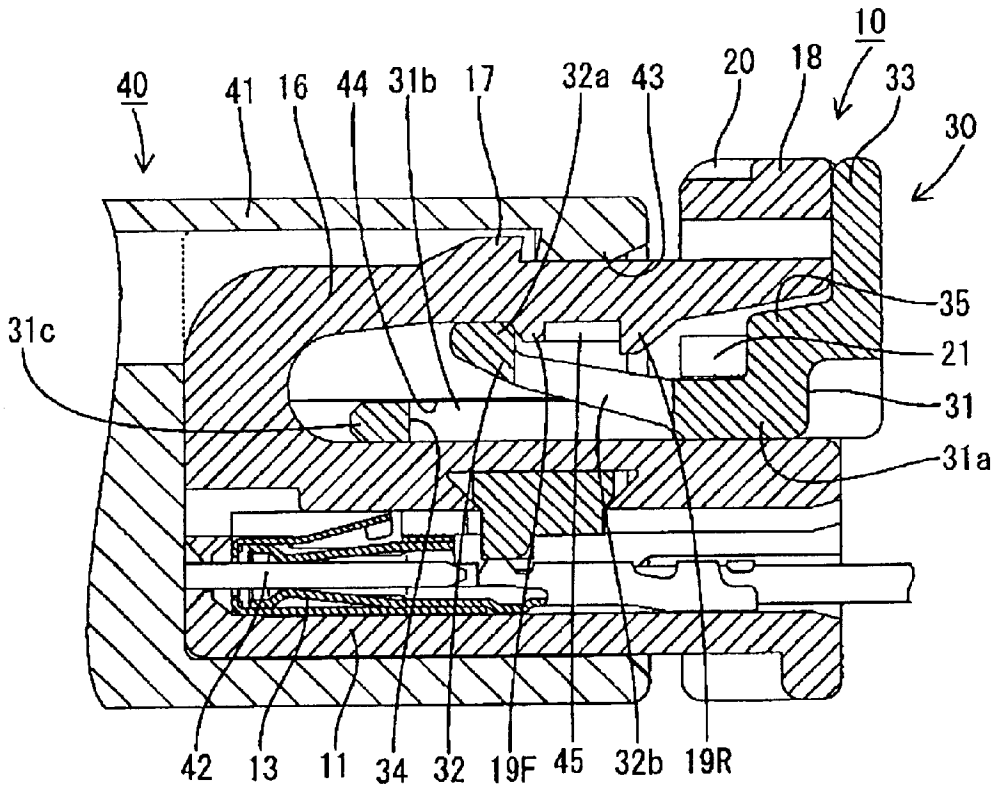
FIG. 12 is a section similar to FIG. 9, showing a state where the two connectors are properly connected and the detector is at a detection position.
Figure 13:
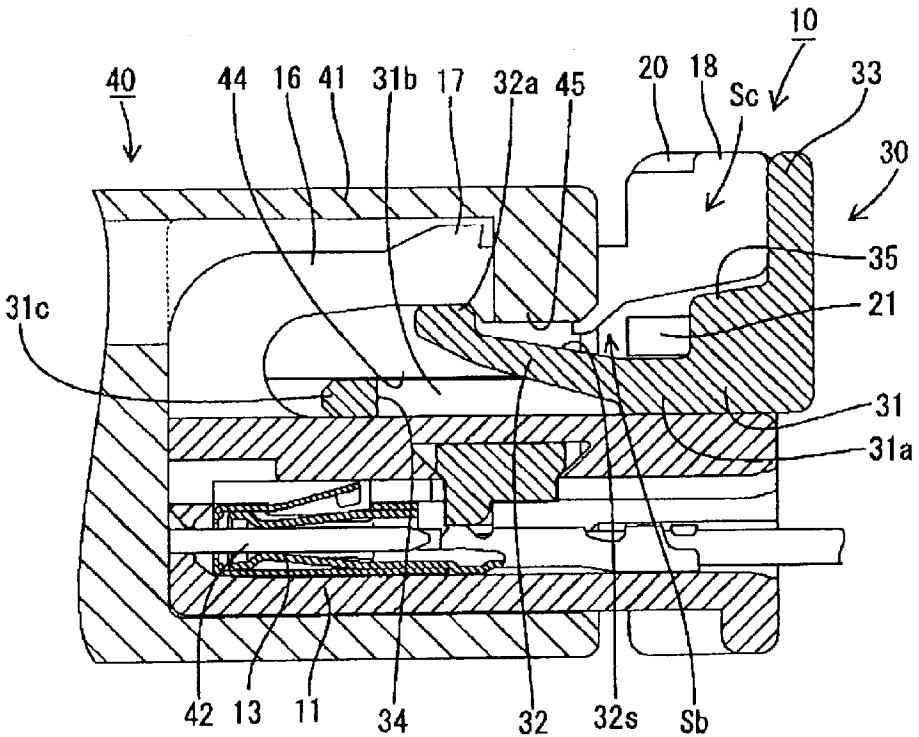
FIG. 13 is a section along 13—13 of FIGS. 1, 4 and 8 showing the two connectors properly connected and the detector at the detection position.

Thereafter, fingers are or can be placed on the grip portion 33 to push the detector 30 in the moving direction MD, preferably forward. When the detector 30 is pushed toward or to the detection position, the locking portion 32*a* passes the front locking projection 19F and the resilient locking piece 32 resiliently returns, preferably upward, whereby the locking projection 32*a* is engaged with the front locking projection 19F from front as shown in FIG. 12. The detector 30 is held at the detection position by this engagement while being prevented from making returning backward movements (toward the standby position). As described above, whether or not the two connectors 10, 40 have been properly connected can be detected based on whether or not the detector 30 can be pushed in the moving direction MD to the detection position.

Upon separating the properly connected connectors 10, 40 for maintenance or other reason, locking effected by the lock arm 16 is canceled by pushing the unlocking portion 18 down. With the detector 30 left at the detection position, a resilient deformation of the lock arm 16 in unlocking direction is hindered by the displacement restricting portion 35.

Thus, it is necessary to first disengage the locking portion 32*a* of the resilient locking piece 32 from the locking projection 19F of the lock arm 16 and move the detecting member 30 from the detection position to the standby position before locking effected by the lock arm 16 is or can be canceled. However, since the resilient locking piece 32 is still at least partly accommodated in the receptacle 41, the narrow and long jig J is to be used to disengage the locking portion 32*a* and the locking projection 19F. A structure for the insertion of the jig J is as follows.

Figure 4:
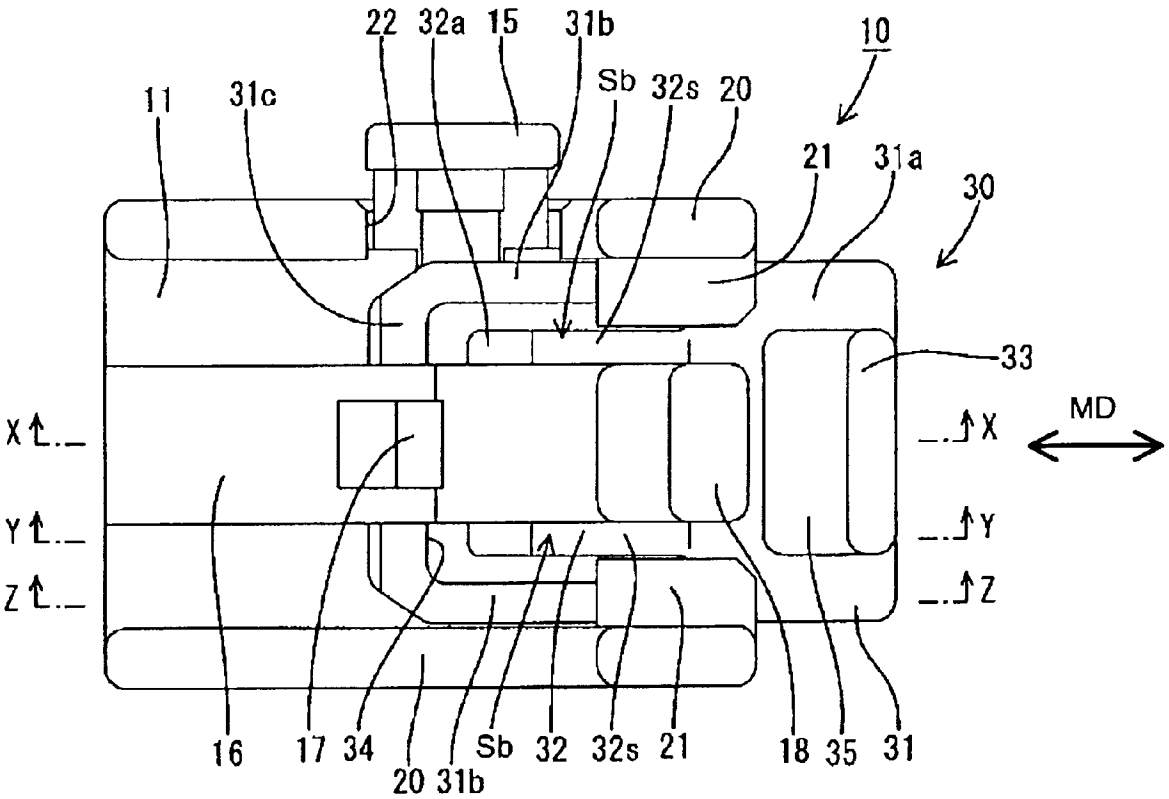
FIG. 4 is a plan view of the first connector with the detector at a standby position.
Figure 5:
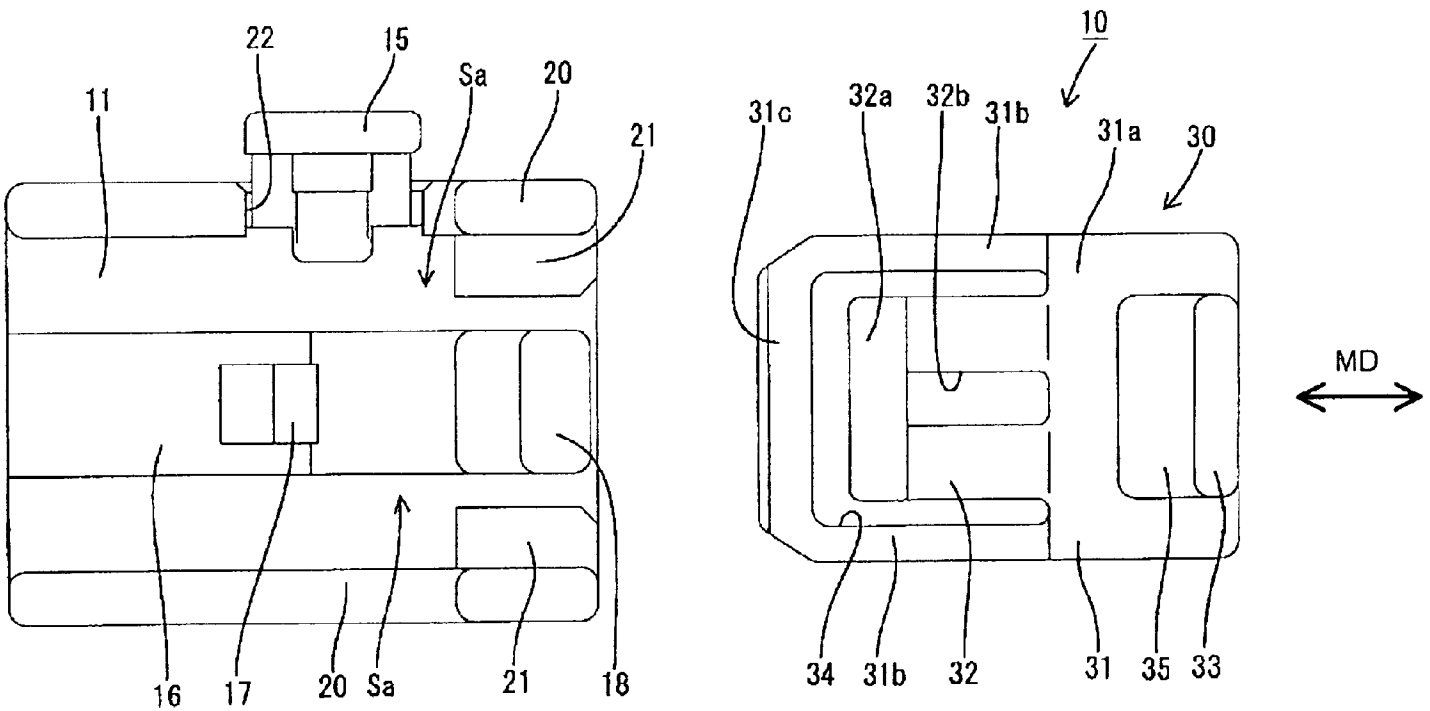
FIG. 5 is a plan view of the first connector with the detector detached from the housing.
Figure 6:
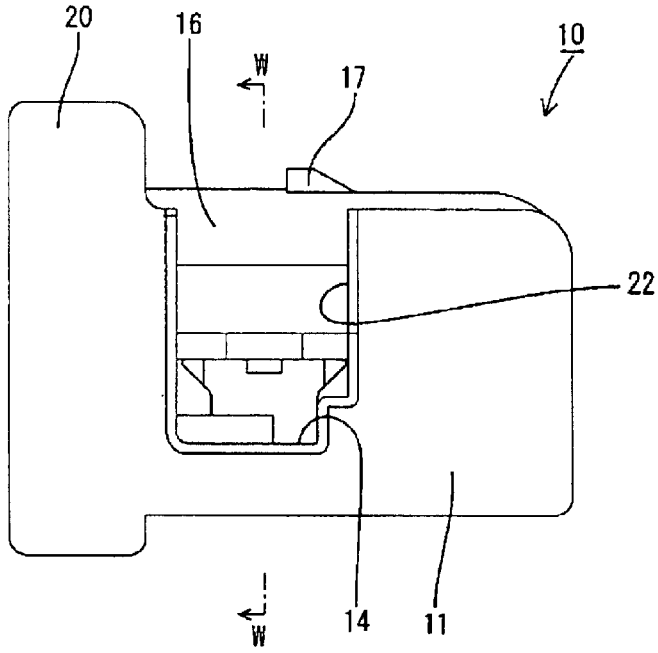
FIG. 6 is a left side view of the first connector.
Figure 7:
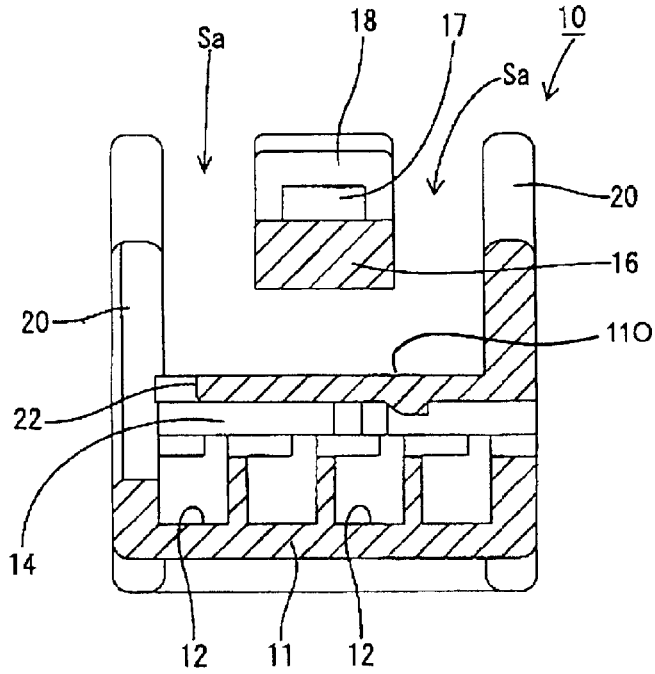
FIG. 7 is a section along 7—7 of FIG. 6.
Figure 8:
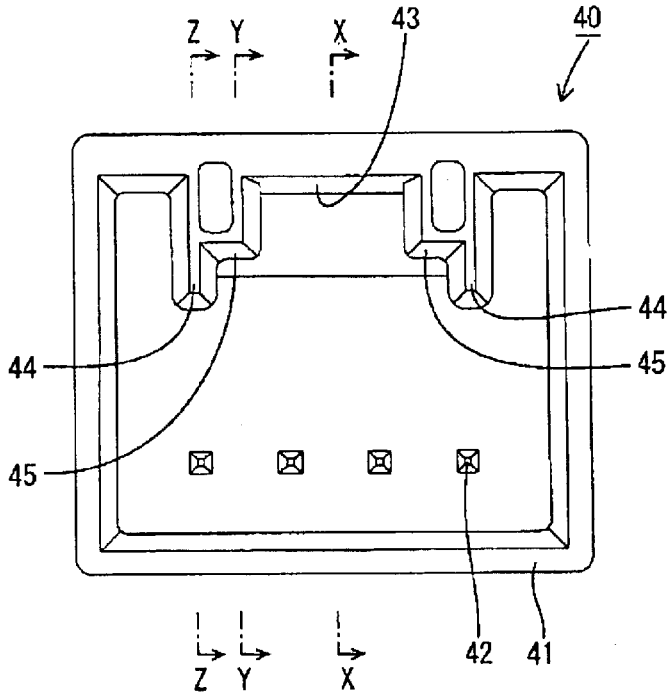
FIG. 8 is a front view of a second connector.
Figure 9:
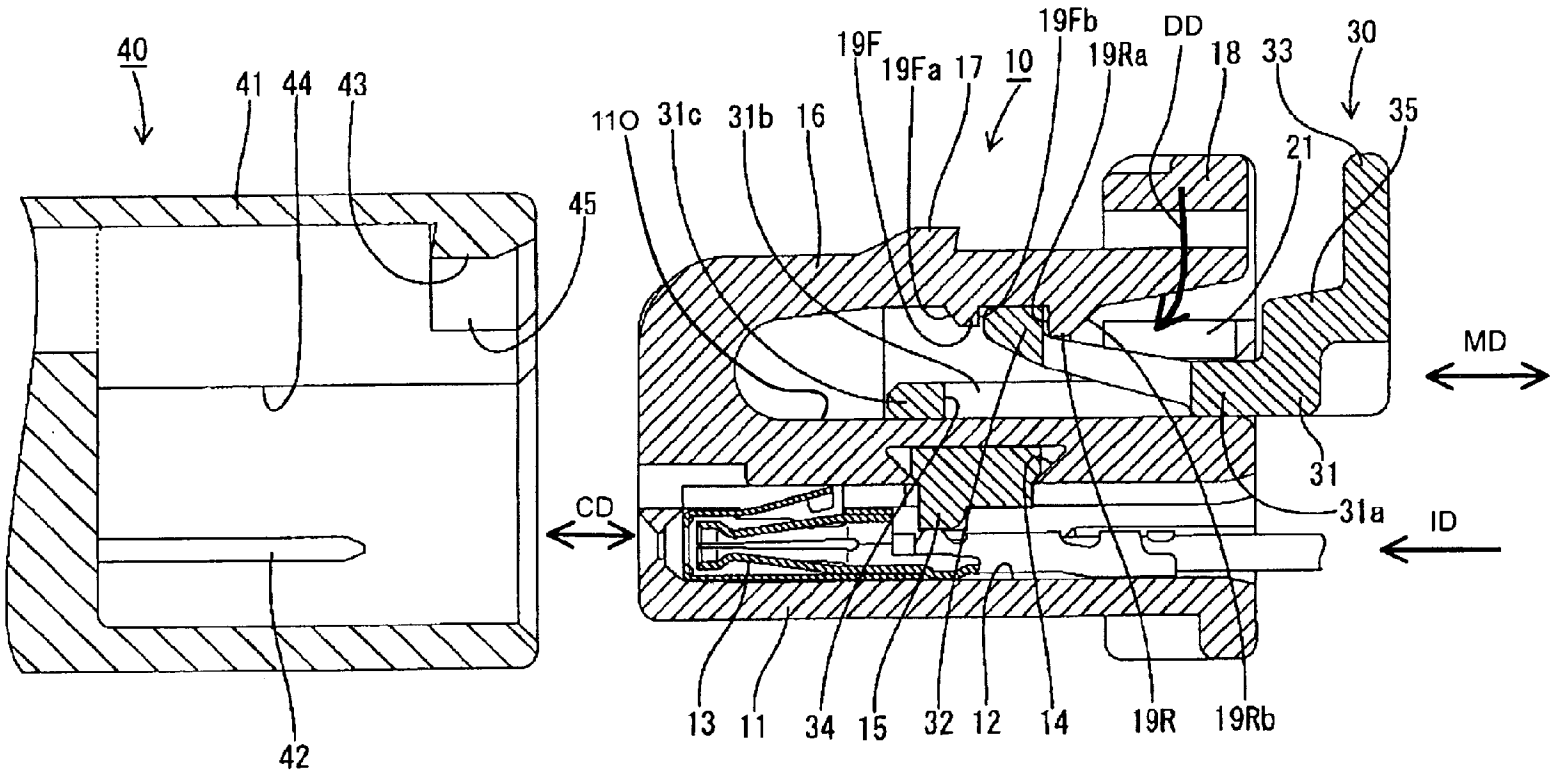
FIG. 9 is a section along 9—9 of FIGS. 1, 4 and 8 showing a state where the two connectors are separated.
Figure 14:
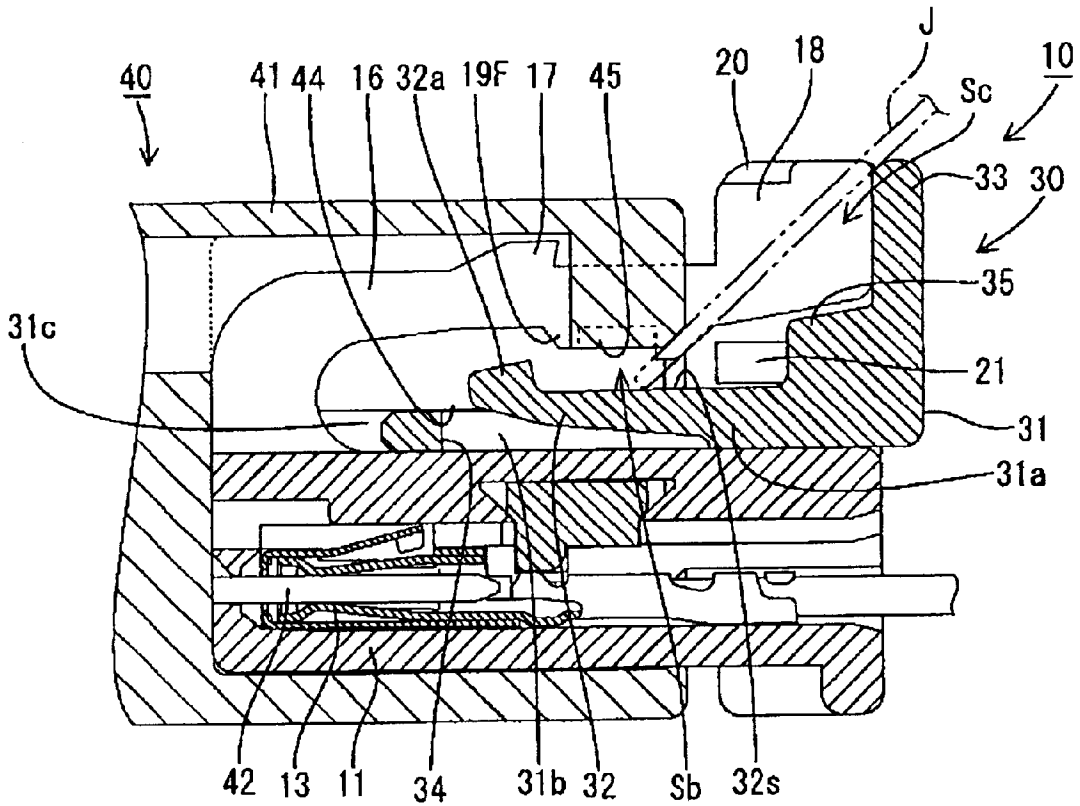
FIG. 14 is a section similar to FIG. 13, but showing a resilient locking piece resiliently deformed in a direction to disengage from a lock arm by a jig.
Figure 15:
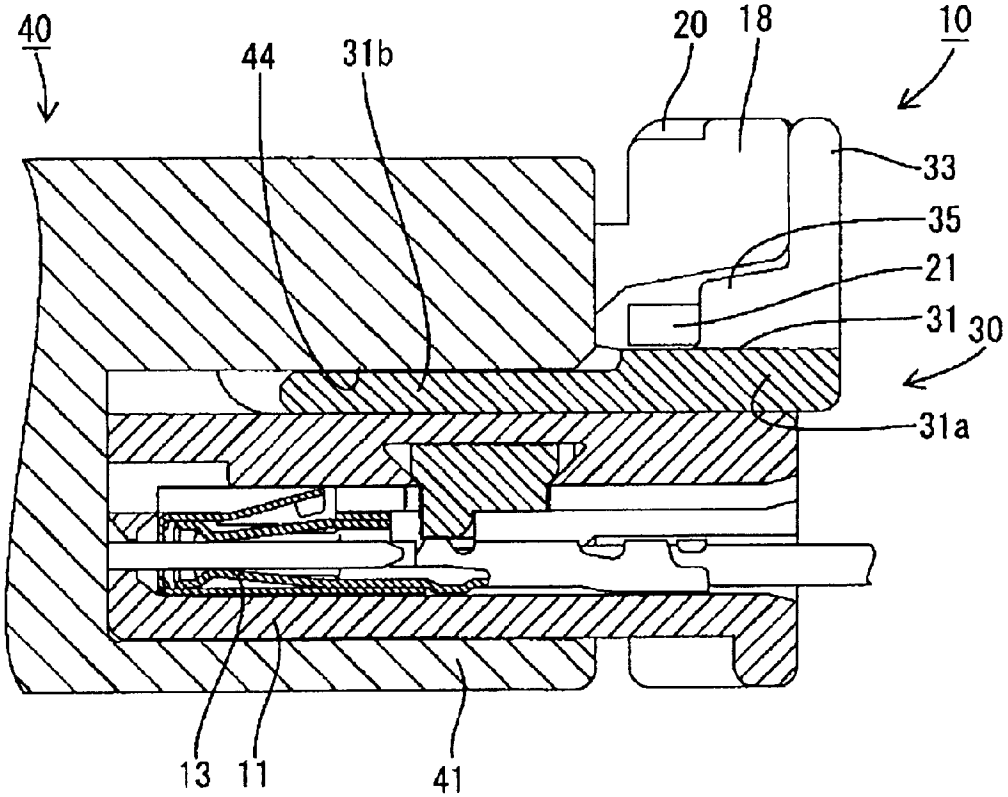
FIG. 15 is a section along 15—15 of FIGS. 1, 4 and 8 the two connectors properly connected and the detector at the detection position.

The left and right sides of the resilient locking piece 32 bulge out at the left and right sides of the lock arm 16, and the upper surfaces of these bulging portions 32*s* are exposed to narrow spaces Sb between the lock arm 16 and the guiding portions 21 and the auxiliary guiding portions 44 (see FIG. 4). The upper plate of the receptacle 41 is right above the bulging portions 32S, and the grip portion 33 and the displacement restricting portion 35 are located right behind the bulging portions 32*s*. The spaces Sb to which the bulging portions 32*s* are exposed communicate with a clearance Sc defined by the grip portion 33 and the displacement restricting portion 35 and the upper opening edge of the receptacle 41, and the bulging portions 32*s* of the resilient locking piece 32 can be seen through the spaces Sb and/or the clearance Sc from the outside of the receptacle 41. Specifically, the narrow and long jig J inserted into the clearance Sc and the space Sb from the outside of the receptacle 41 can reach the bulging portion 32*s* of the resilient locking piece 32 and can be operated to push the resilient locking piece 32 down, thereby disengaging the locking portion 32*a* from the front locking projection 19F as shown in FIG. 14. When the detector 30 is moved to the standby position located behind in this state, the locking portion 32*a* is engaged with the locking projections 19F, 19R to hold the detector 30 at the standby position.

As described above, the lock projection 17 is formed on the outer surface of the lock arm 16 for locking the two connectors 10, 40 in their connected state and the locking projections 19F, 19R are formed on the inner surface of the lock arm 16 for holding the detector 30 at the standby position. In other words, the projections are formed as the locking means instead of a recess and, accordingly, an opening in the form of a through hole needs not be formed in the lock arm 16. Thus, the lock arm 16 of this embodiment has a higher strength as compared to the one formed with an opening penetrating the lock arm from the outer surface to the inner surface as a locking means.

Since parts of the resilient locking piece 32 are at least partly exposed to outside at the sides of the lock arm 16, the resilient locking piece 32 can be disengaged from the lock arm 16 by bringing the jig J substantially into contact with the exposed surfaces (bulging portions 32*s*) of the resilient locking piece 32 to resiliently deform the resilient locking piece 32. In other words, a sufficient strength is ensured for the lock arm 16 since the lock arm 16 needs not be formed with a window hole used to insert the jig.

Further, since the detector 30 is provided with the displacement restricting portion 35 for restricting the displacement of the lock arm 16 in unlocking direction by being located between the housing 11 and the lock arm 16 with the detecting member 30 located at the detection position, the two connectors 10, 40 can be securely locked into each other.

Furthermore, since the displacement restricting portion 35 is also provided with a function of hindering the movement of the detector 30 to the detection position when the two connectors 10, 40 are left partly connected, the shape can be simplified as compared to a case where a movement restricting means for hindering the movement of the detector 30 to the detection position is provided separately from the displacement restricting portion 35.

Further, since the guiding portions 21 for restricting loose movements of the detector 30 along a direction intersecting with the moving directions MD while the detector 30 is moved between the standby position and the detection position are provided, the detector 30 can be smoothly and securely moved along a specified path between the detection position and the standby position by being guided by the guiding portions 21.

Furthermore, the second connector 40 is provided with the auxiliary guiding portions 44 for restricting loose movements of the detector 30 along a direction intersecting with the moving directions MD while the detector 30 is moved between the standby position and the detection position with the second connector 40 connected with the first connector 10. Thus, the detector 30 can be moved smoothly and securely along a specified path between the detection position and the standby position by being guided by both the guiding portions 21 and the auxiliary guiding portions 44.

The guidable portion 31 guided by the guiding portions 21 and the auxiliary guiding portions 44 is located at the side (lower side) of the resilient locking piece 32 substantially opposite from the lock arm 16. This guidable portion 31 is formed with the deformation space 34 for avoiding the interference with the resilient locking piece 32 when the resilient locking piece 32 is resiliently deformed in such a direction as to be disengaged from the locking projections 19F, 19R of the lock arm 16. In other words, since the deformation space 34 for the resilient locking piece 32 is defined, taking advantage of the thickness of the guidable portion 31, the height of the first connector 10 can be reduced with respect to the resilient deforming direction of the resilient locking piece 32 as compared to a structure in which a space between a guidable portion and a resilient locking piece serves as the deformation space 34.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the first and second connectors are respectively provided with the guiding portions and the auxiliary guiding portions as means for guiding the detecting member in the foregoing embodiment, the guiding means for the detecting member may be provided in only either one of the first and second connectors.

Although the first connector is a female connector and a second connector in the foregoing embodiment, the present invention is also applicable to a case where the first connector is a male connector and a second connector is a female connector.

What is claimed is:

1. A connection detecting connector (10) connectable with a mating connector (40), comprising:

a lock arm (16) extending substantially along an outer surface (11O) of a housing (11), and a detector (30) at least partly between the housing (11) and the lock arm (16) for movement between a standby position (FIGS. 4; 9; 10; 11) and a detection position (FIGS. 12; 13; 14; 15), the detector (30) being held at the standby position by engaging the lock arm (16) from an inner side during connection of the connectors (10, 40) and being permitted to move to the detection position when the connectors (10, 40) are properly connected, wherein:

a lock projection (17) for locking the two connectors (10, 40) in their connected state by being engageable with a receiving portion (43) of the mating connector (40) is formed on an outer surface of the lock arm (16), and at least one locking projection (19R; 19F) on an inner surface of the lock arm (16) for engaging the detector (30) and holding the detector (30) at the standby position.

2. The connection detecting connector of claim 1, wherein: the detector (30) moved to the detection position is prevented from returning to the standby position by the engagement of a resilient locking piece (32) provided in the detector (30) with the inner surface of the lock arm (16).

3. The connection detecting connector of claim 2, wherein a part of the resilient locking piece (32) is exposed to outside at the side of the lock arm (16) and the resilient locking piece (32) can be displaced in such a direction as to be disengaged from the lock arm (16) by bringing a jig (J) into contact with an exposed surface (32*s*) of the resilient locking piece (32).

4. The connection detecting connector of claim 1, wherein the detector (30) comprises a displacement restricting portion (35) for restricting a displacement of the lock arm (30) in unlocking direction by being at least partly located between the housing (11) and the lock arm (16) with the detector (30) located at or near the detection position.

5. The connection detecting connector of claim 1, further comprising at least one guiding portion (21) for hindering loose movements of the detector (30) along a direction intersecting with moving directions (MD) of the detector (30) while the detector (30) is moved between the standby position and the detection position.

6. The connection detecting connector of claim 5, wherein the detector (30) comprises at least one guidable portion (31) to be guided by the guiding portion (21) at a side of the resilient locking piece (32) substantially opposite from the lock arm (16).

7. The connection detecting connector of claim 6, wherein the guidable portion (31) has a deformation space (34) for avoiding an interference with the resilient locking piece (32) when the resilient locking piece (32) is resiliently deformed in a direction to be disengaged from the lock arm (16).

8. The connection detecting connector of claim 1, wherein at least one locking surface (19Fa; 19Fb; 19Ra; 19Rb) engageable with the resilient locking piece (32) is formed on the inner surface of the lock arm (16), the housing (11) is formed with a retainer accommodating hole (14) for at least partly accommodating a retainer (15) for locking at least one terminal fitting (13) at least partly inserted into the housing (11), and the locking surface (19Fa; 19Fb; 19Ra; 19Rb) is substantially parallel with a mounting direction of the retainer (15) into the retainer accommodating hole (14).

9. A connection detecting connector assembly comprising:

a connection detecting connector (10) according to claim 1 as a first connector (10), and a second connector (40) connectable with the first connector (10), the first and second connectors (10, 40) being locked in their connected state by engaging an outer side of the lock arm (16) with the second connector (40) with the first and second connectors (10, 40) connected with each other.

10. The connection detecting connector assembly of claim 9, wherein the second connector (40) comprises an auxiliary guiding portion for hindering loose movements of the detecting member along a direction intersecting with the moving directions of the detector while the detector is moved between the standby position and the detection position with the mating connector (40) connected with the connector (10).

11. The connection detecting connector assembly of claim 10, wherein the detector (30) comprises at least one guidable portion (31) to be guided by the guiding portion (21) and the auxiliary guiding portion (44) at a side of the resilient locking piece (32) substantially opposite the lock arm (16).

* * * * *